US006854874B2

(12) United States Patent
Graham, Sr.

(10) Patent No.: US 6,854,874 B2
(45) Date of Patent: Feb. 15, 2005

(54) GEL HYDRATION SYSTEM

(75) Inventor: Jayce L. Graham, Sr., Bakersfield, CA (US)

(73) Assignee: Halliburton Energy Services, Inc., Duncan, OK (US)

( * ) Notice: Subject to any disclaimer, the term of this patent is extended or adjusted under 35 U.S.C. 154(b) by 177 days.

(21) Appl. No.: 10/282,668

(22) Filed: Oct. 29, 2002

(65) Prior Publication Data

US 2004/0081015 A1 Apr. 29, 2004

(51) Int. Cl.[7] ..... B01F 5/04
(52) U.S. Cl. ..... 366/173.1; 366/175.2
(58) Field of Search ..... 366/167.1, 173.1, 366/173.2, 174.1, 175.2, 181.6, 134

(56) References Cited

U.S. PATENT DOCUMENTS 1,135,080 A * 4/1915 Vandercook
3,194,539 A * 7/1965 Hanne-Wiame
3,799,508 A * 3/1974 Arnold et al.
4,332,484 A * 6/1982 Peters
4,812,045 A * 3/1989 Rivers
4,828,034 A 5/1989 Constien et al.
5,046,856 A 9/1991 McIntire
5,052,486 A 10/1991 Wilson
5,863,119 A * 1/1999 Yergovich et al.
6,357,906 B1 * 3/2002 Baudoin et al.
2002/0105855 A1 8/2002 Behnke et al.
2003/0150494 A1 8/2003 Morgan et al.

FOREIGN PATENT DOCUMENTS

EP 0 508 817 A1 10/1992
JP 2000-254467 * 9/2000

* cited by examiner

*Primary Examiner*—Charles E. Cooley
(74) *Attorney, Agent, or Firm*—John W. Wustenberg; Anthony L. Rahhal

(57) ABSTRACT

A hydration apparatus for use with a hydration tank. The hydration apparatus disperses incoming gel into existing gel in the hydration tank to increase the hydration time of the incoming gel. The hydration apparatus includes flow conduits communicated with gel inlets in the hydration tank. The flow conduits redirect the flow of the incoming gel. The flow conduits preferably redirect the flow from a generally horizontal direction to generally vertically upwardly direction. The hydration apparatus has a plurality of deflectors positioned in the hydration tank. Flow exiting an end of the flow conduits is deflected by the deflectors and dispersed into existing gel in the hydration tank. The flow conduits are preferably perforated flow conduits so that a portion of incoming gel passes through openings in the sides of the flow conduits while a portion of the incoming gel passes through an exit of the flow conduits. Incoming gel is therefore sufficiently dispersed into existing gel to increase the hydration time of incoming gel.

19 Claims, 9 Drawing Sheets

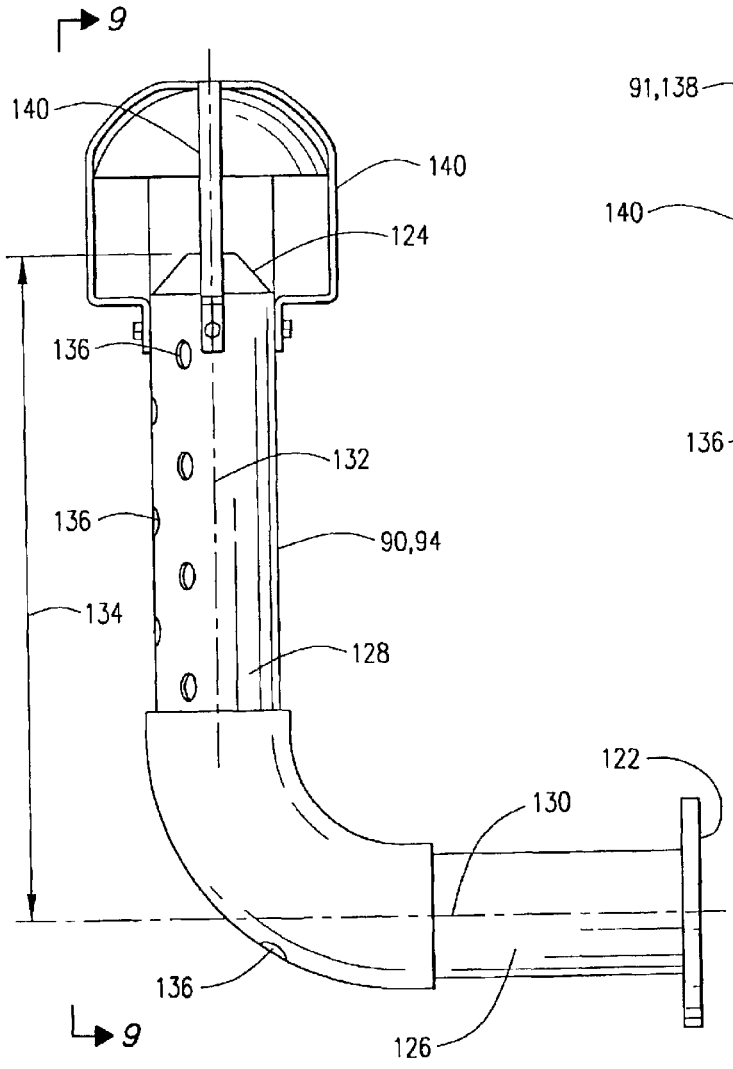
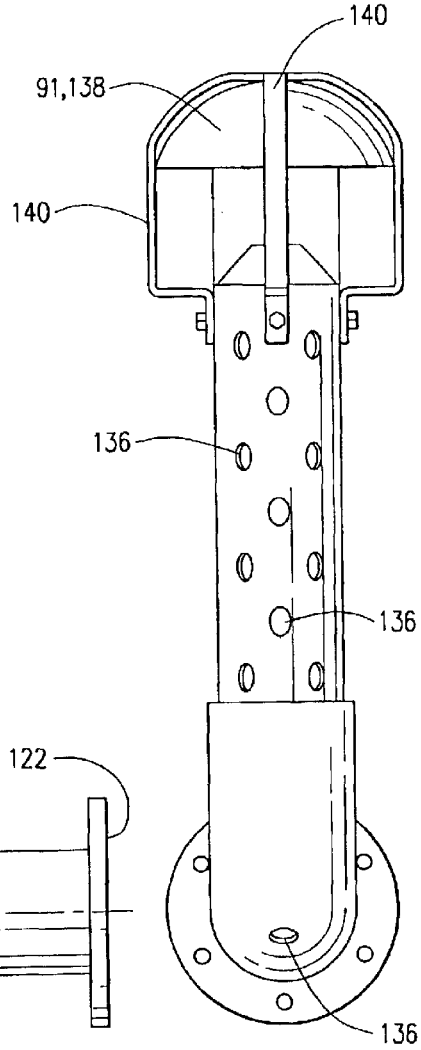
FIG. 8
FIG. 9

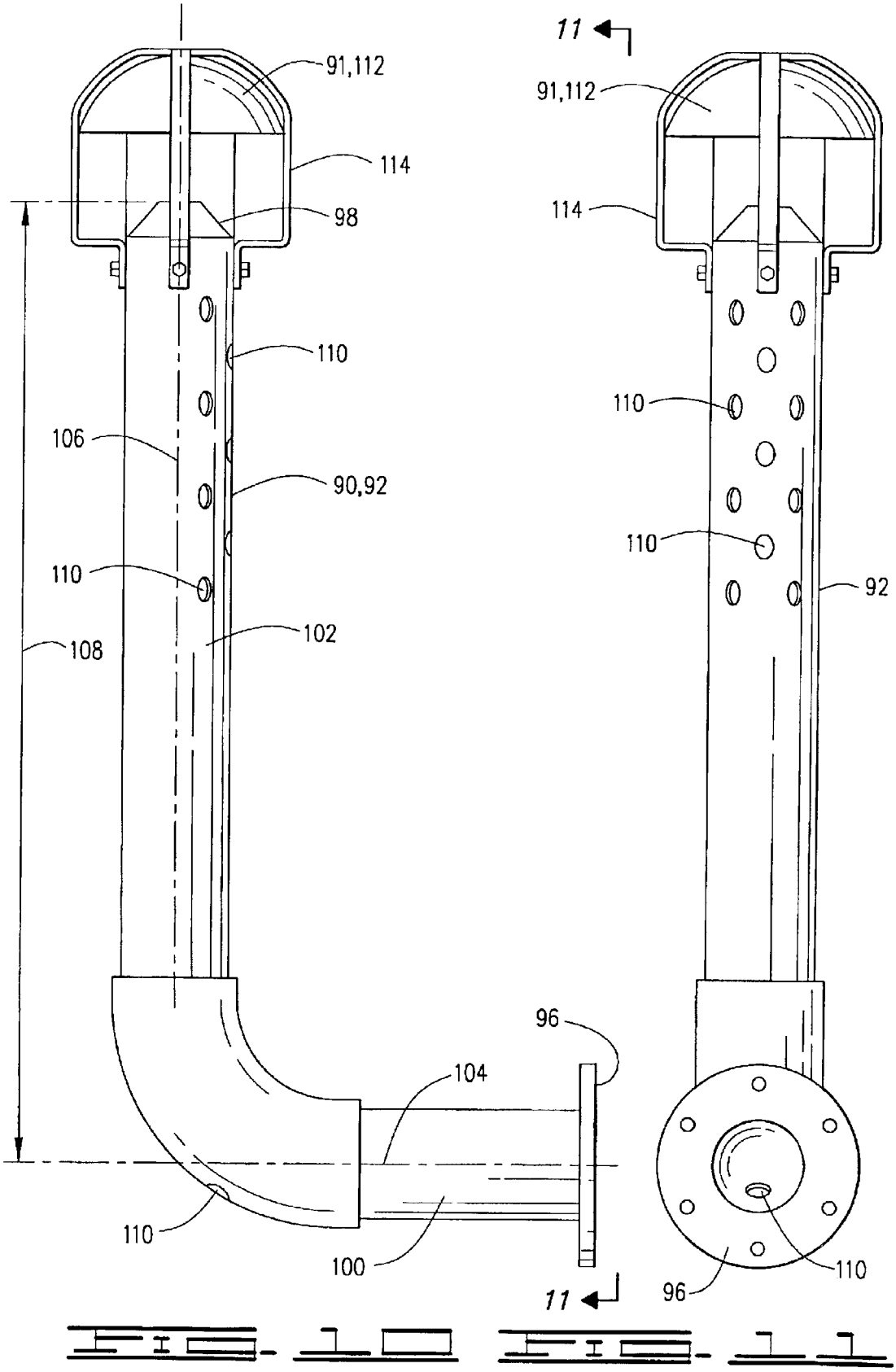
91,112
114
98
110
106
90,92
110
102
108
110
100
104
96
11
11
91,112
114
110
110
92
96
110

GEL HYDRATION SYSTEM

BACKGROUND OF THE INVENTION

The present invention relates to a method and apparatus for hydrating a gel, and more specifically to improved methods and apparatus for hydrating a fracturing gel, or fracturing fluid in a hydration tank.

Producing subterranean formations penetrated by wellbores are often treated to increase the permeabilities of conductivities thereof. One such production stimulation involves fracturing the subterranean formation utilizing a viscous treating fluid. That is, the subterranean formation or producing zone is hydraulically fractured whereby one or more cracks or fractures are created therein.

Hydraulic fracturing is typically accomplished by injecting a viscous fracturing fluid, which may have a proppant such as sand or other particulate material suspended therein, into the subterranean formation or zone at a rate and pressure sufficient to cause the creation of one or more fractures in the desired zone or formation. The fracturing fluid must have a sufficiently high viscosity to retain the proppant material in suspension as the fracturing fluid flows into the created fractures. The proppant material functions to prevent the formed fractures from closing upon reduction of the hydraulic pressure which was applied to create the fracture in the formation or zone whereby conductive channels remain in which produced fluids can readily flow to the wellbore upon completion of the fracturing treatment. There are a number of known fracturing fluids that may be utilized including water-based liquids containing a gelling agent comprised of a polysaccharide, such as for example guar gum. Prior to being mixed with proppant, the fracturing fluid is typically held in a hydration tank. A prior art hydration tank is shown in FIGS. 1–3. FIG. 1 is a cross-sectional side view of a prior art hydration tank referred to as a T-tank. Hydration tank 10 has an inflow portion 15, an outflow portion 20, and a weir plate 25 separating the inflow portion 15 from the outflow portion 20.

Hydration tank 10 includes a plurality of inlets 30 and the prior art tank shown includes four inlets 30. As is known in the art, gel will be communicated through inlets 30 into inflow portion 15. Hydration tank 10 may also include a drain conduit or tube 32. Drain conduit 32 has a lower end 33 that is positioned over, and preferably extends into a depression or cup 35 formed in the bottom 37 of tank 10. Drain conduit 32 is utilized to drain hydration tank 10, but may also be utilized to communicate gel into hydration tank 10.

Incoming gel is communicated into hydration tank 10 from a pre-blender (not shown) through inlets 30 generally horizontally toward weir plate 25. Incoming gel communicated through drain tube 32 will be communicated into the hydration tank 10 in a generally vertically downward direction. The gel communicated into hydration tank 10 may typically comprise a liquid gel concentrate (LGC) mixed with water. The LGC may comprise, for example, guar mixed with diesel. One such liquid gel concentrate may comprise guar mixed with diesel such that the resulting LGC includes four pounds of guar per gallon of LGC. The LGC may comprise other known gel concentrates. The LGC is mixed with water and is communicated into hydration tank 10. When hydration tank 10 is being used to communicate gel, which may also be referred to as fracturing gel, or fracturing fluid, into a well, flow through a roll tube 38 and through interior drain valves 40 is prevented with valves or other means known in the art. When hydration tank 10 is being filled, gel is communicated over weir plate 25 into outflow portion 20. Because of the time it takes to initially fill hydration tank 10, the initial gel in the hydration tank 10 will be hydrated sufficiently so that it will have a desired viscosity when it exits hydration tank 10. Once hydration tank 10 is full, valves on the gel outlets 42 may be opened to allow flow from hydration tank 10 into a blender tub or other apparatus known in the art for mixing proppant with the gel prior to displacing the fracturing fluid into the well. Gel is communicated from hydration tank 10 at an approximate rate of forty barrels per minute, but the rate of flow can be varied as desired. Typically the flow rate is monitored so that gel is pumped into hydration tank 10 at approximately the same rate as flow out of hydration tank 10. In some cases the pre-blenders, which mix LGC with water, can only provide a rate of flow into hydration tank 10 at a rate of thirty-two to thirty-six barrels per minute so the level of gel in outflow portion 20 tends to be lower than that of inflow portion 15 during the fracturing process.

With the existing prior art design as shown in FIG. 1, the gel coming in through the four gel inlets 30 tends to flow along the bottom 37 of hydration tank 10, and then directly upwardly at weir plate 25 and over the top of weir plate 25. If drain tube 32 is utilized as an inlet, gel tends to engage cup 35 at the bottom 37 of hydration tank 10 and flow directly upwardly to the surface and over the top of weir plate 25. The result is that incoming gel does not have an adequate amount of hydration time. Because the incoming gel does not hydrate sufficiently, the viscosity of the exiting gel is not as high as may be desired, which may result, for example, in a gel that does not carry proppant into the well efficiently. There is therefore a need for a hydration system to be utilized with hydration tanks to insure the proper hydration of incoming gel and to prevent the overuse and waste of liquid gel concentrate.

SUMMARY OF THE INVENTION

The current invention provides a method and apparatus to hydrate gel in a hydration tank. The hydration tank has gel inlets and gel outlets. The hydration system or hydration apparatus for use with the hydration tank includes a plurality of flow conduits, wherein each of the flow conduits is connected to a gel inlet so that gel communicated through a gel inlet is communicated into a flow conduit.

The flow conduits change the direction of the flow of gel passing through the gel inlets. The flow conduits preferably redirect the flow from a generally horizontal direction to a generally vertically upwardly. Incoming gel will flow into the hydration tank through the flow conduits, which redirect and disperse incoming gel into existing gel in the hydration tank. Deflectors are preferably positioned over the exit of each of the flow conduits so that gel passing through the exit of each of the flow conduits will be redirected and dispersed into existing gel by the deflectors. The deflectors may be positioned in the hydration tank as desired to engage the gel exiting the flow conduits but preferably are connected to the flow conduits and positioned directly above the flow conduits.

The flow conduits of the present invention are preferably perforated such that each flow conduit has a plurality of ports or openings in a vertical portion thereof through which incoming gel will pass. Thus, incoming gel will flow out of flow conduits through the ports or openings in the sides thereof and through an exit end of the flow conduit. The ports in the flow conduits are oriented so as to create multi-directional flow of incoming gel into the hydration tank and thus into the existing gel in the hydration tank. The hydration system of the present invention disperses incoming gel into existing gel in such a manner as to increase the time incoming gel hydrates in the hydration tank prior to exiting the hydration tank through gel outlets. With prior art hydration tanks, incoming gel has a tendency to finger through existing gel and exit the hydration tank so quickly that there is insufficient hydration time to reach the desired viscosity.

BRIEF DESCRIPTION OF THE DRAWINGS

FIG. 6 is a view taken from line 6—6 of FIG. 5.

FIG. 8 is a side view of a flow conduit of the present invention.

FIG. 9 is a view taken from line 9—9 of FIG. 8.

FIG. 10 is a side view of an additional embodiment of a flow conduit of the present invention.

FIG. 11 is a view taken from line 11—11 of FIG. 10.

DETAILED DESCRIPTION OF A PREFERRED EMBODIMENT

Figure 1:
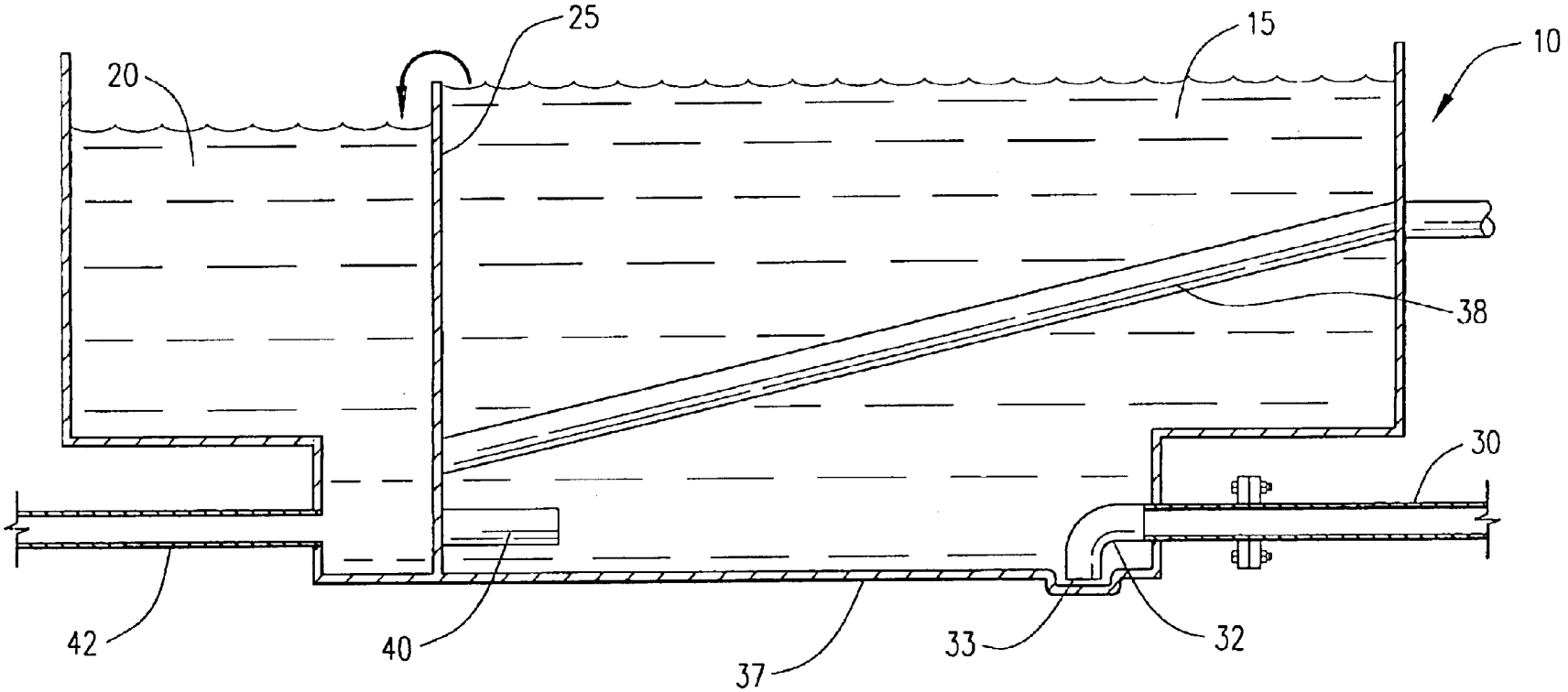
FIG. 1 PRIOR ART
FIG. 1 is a cross-sectional side view of a prior art hydration tank.
Figure 2:
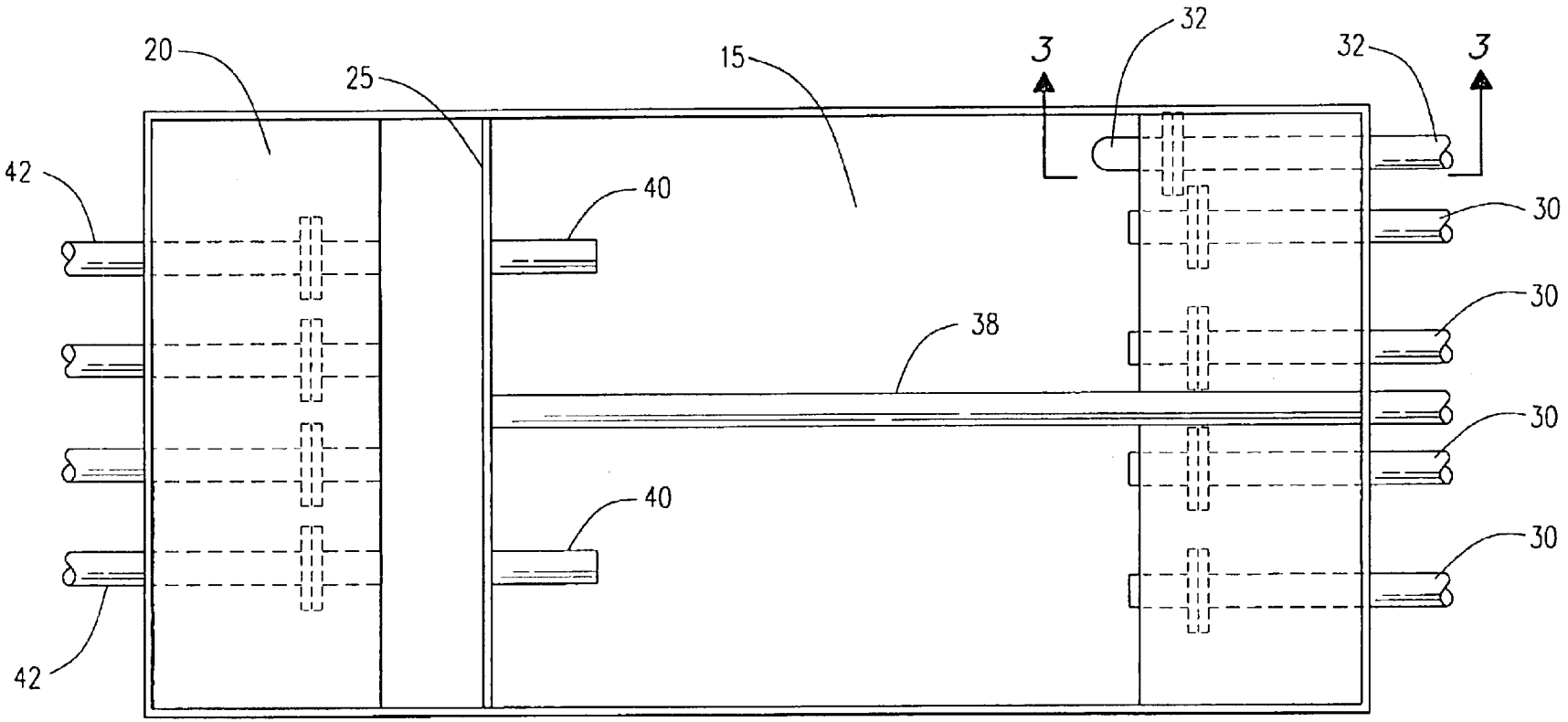
FIG. 2 PRIOR ART
FIG. 2 is a top view of the prior art hydration tank of FIG. 1.
Figure 3:
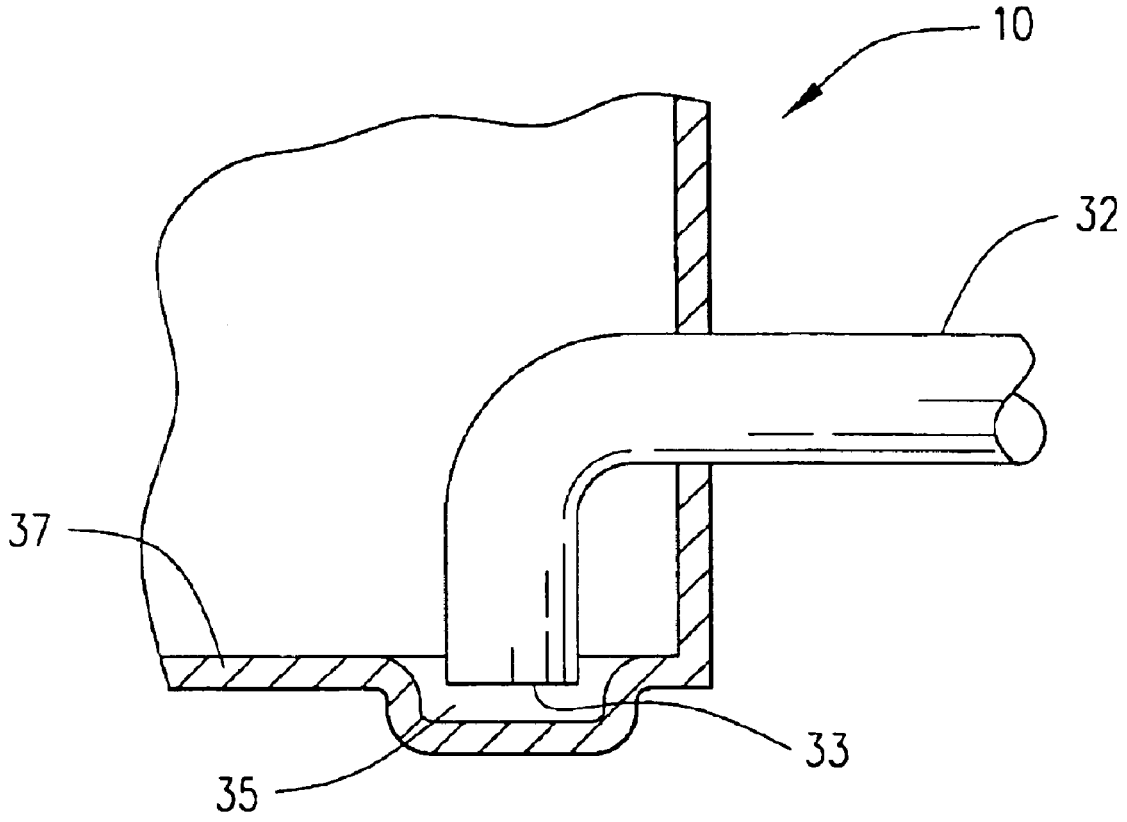
FIG. 3 PRIOR ART
FIG. 3 is a view taken from line 3—3 of FIG. 2.
Figure 4:
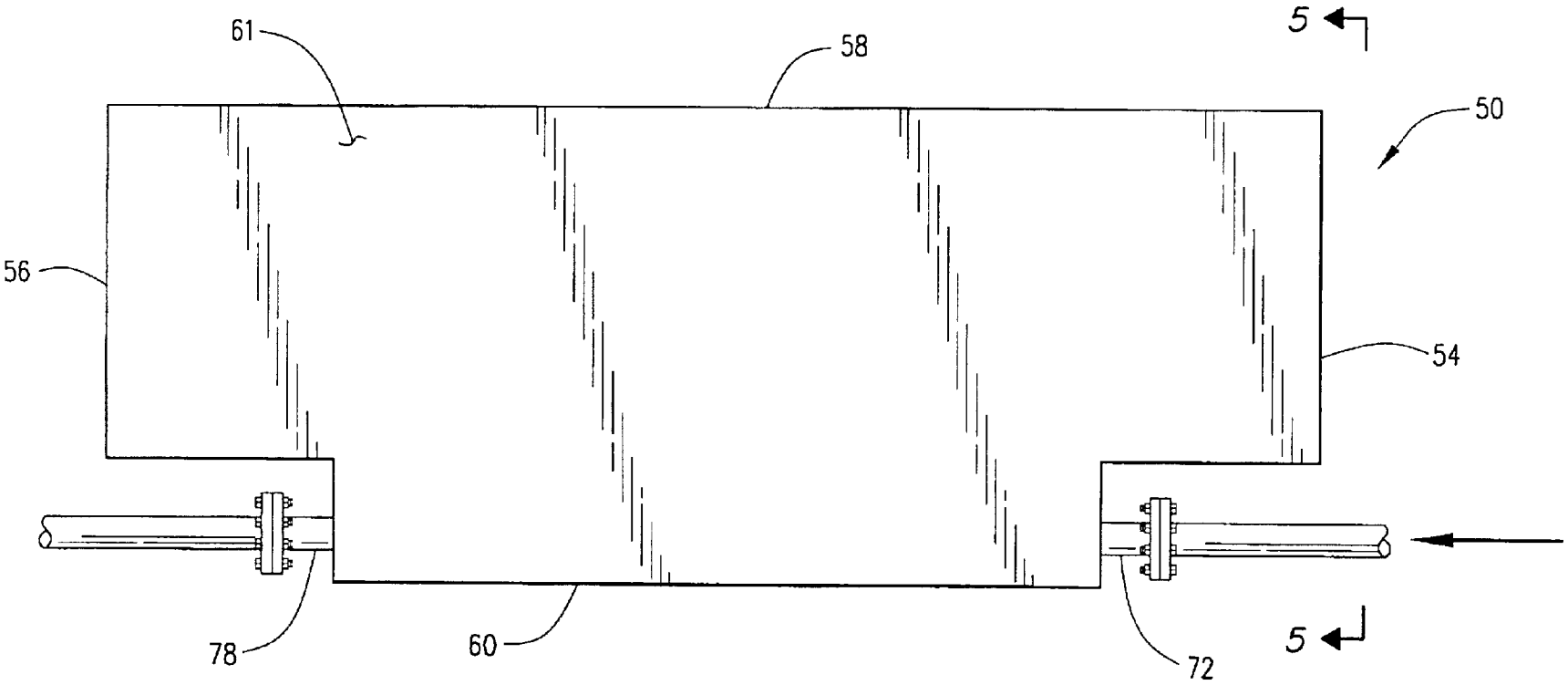
FIG. 4 is a side view of a hydration tank of the present invention.
Figure 5:
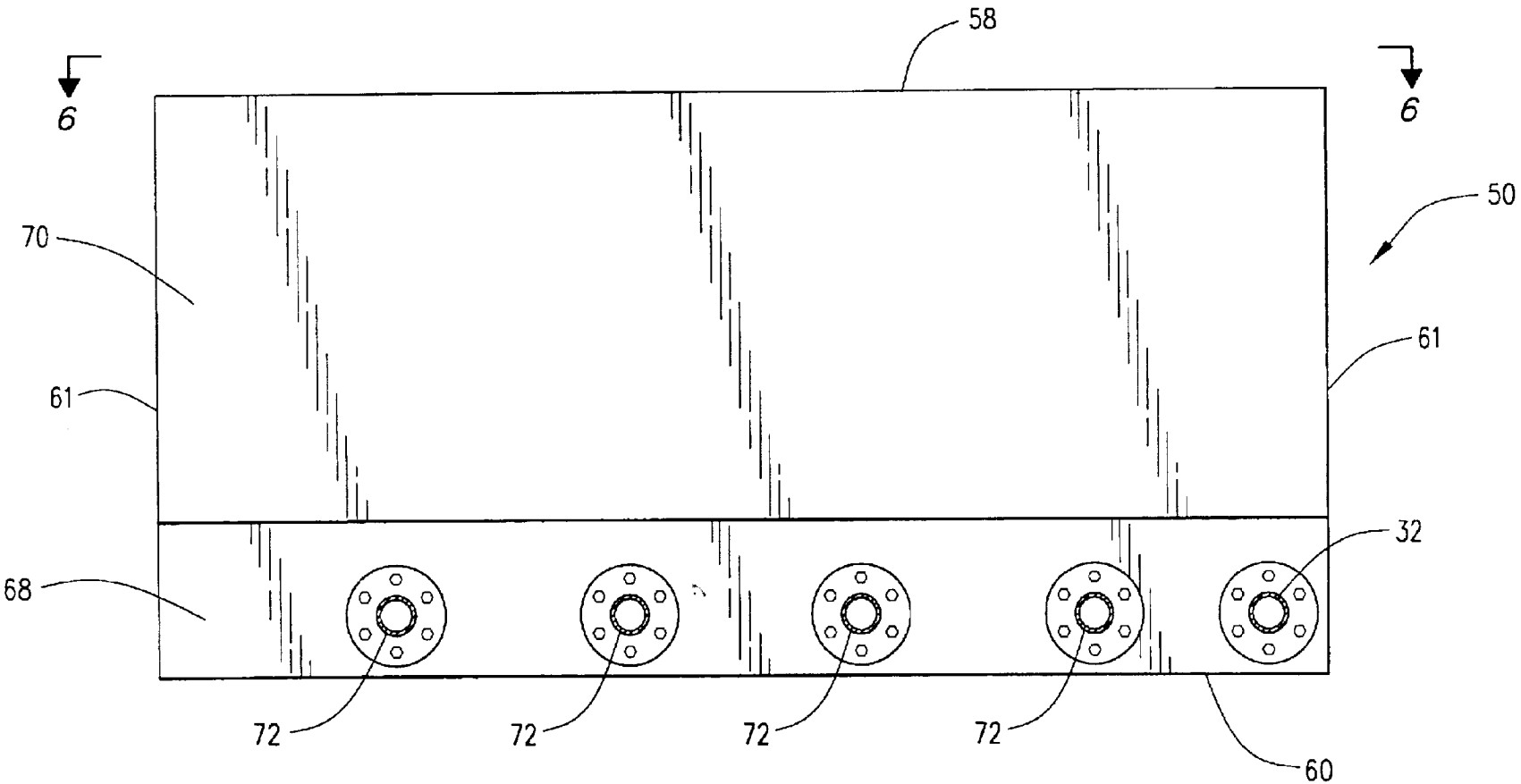
FIG. 5 is a view from line 5—5 of FIG. 4.
Figure 5:
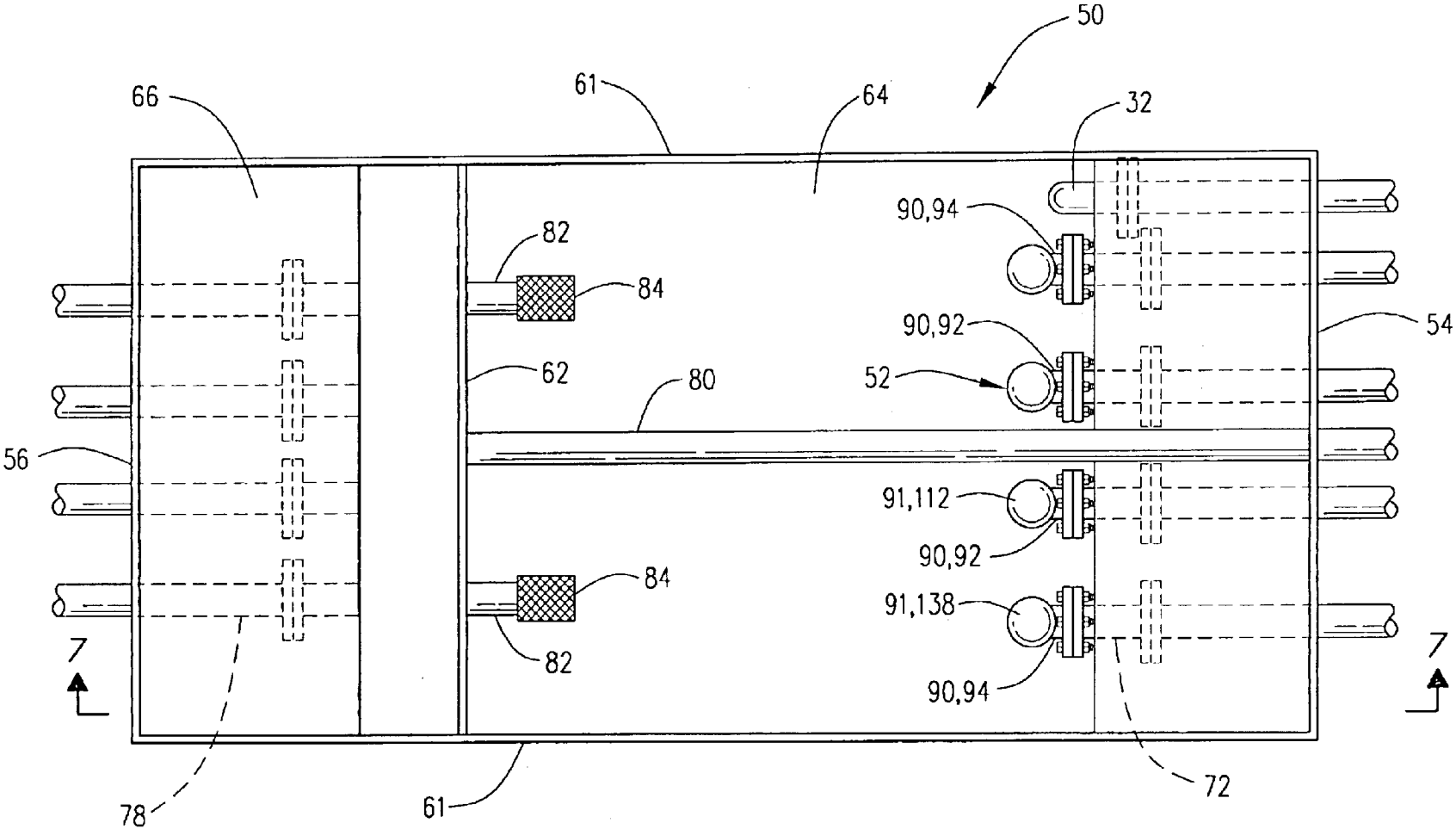
Figure 7:
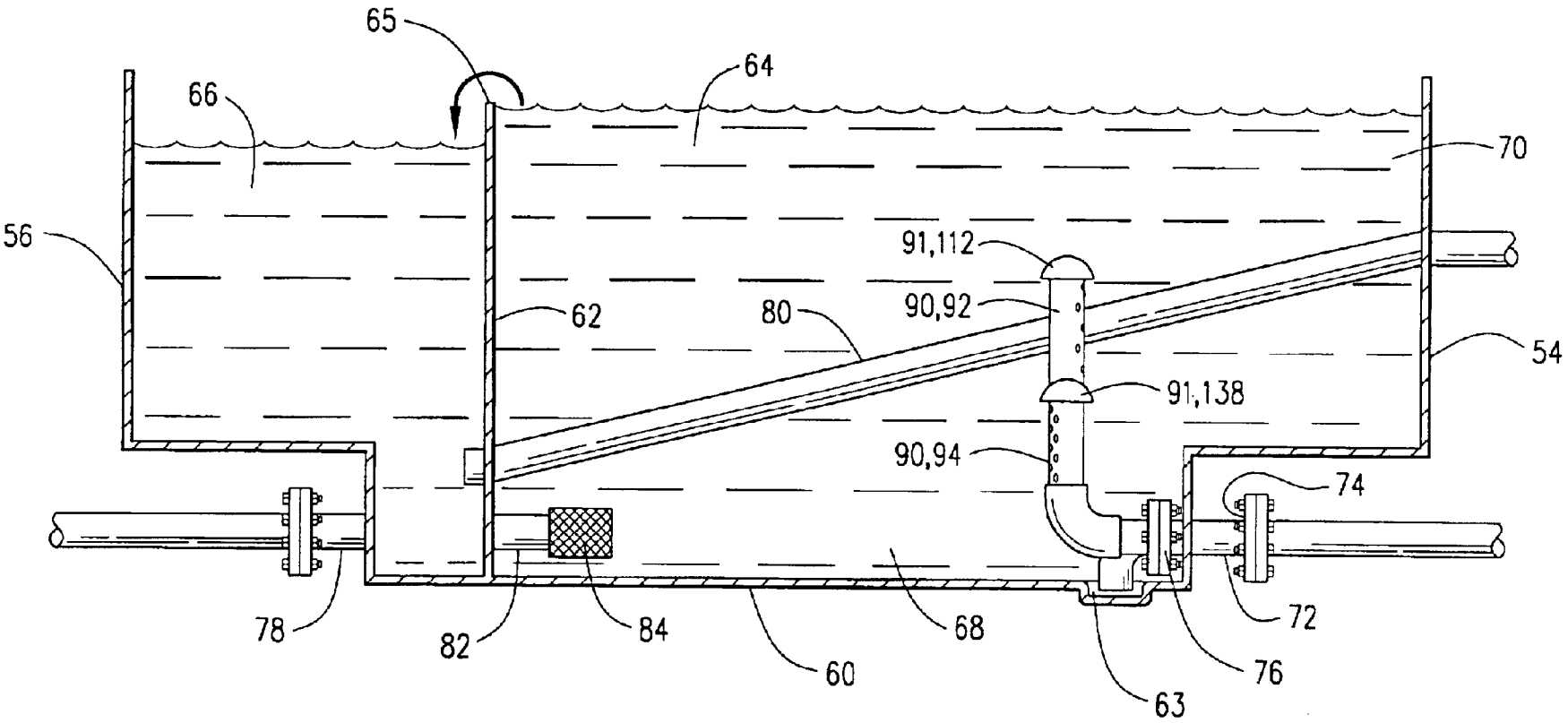
FIG. 7 is a cross-sectional view taken from line 7—7 of FIG. 6.

Hydration tank 50, including the hydration apparatus or hydration system 52 of the present invention is shown in FIGS. 4–11. Hydration tank 50 has an inflow or forward end 54, an outflow or rear end 56, a top 58, a bottom 60, and sides 61. Bottom 60 may include a cup or depression 63 therein. A weir plate 62 divides the hydration tank 50 into an inflow portion 64 and an outflow portion 66. Gel in the hydration tank 50 will roll over an upper end 65 of weir plate 62. As is apparent from the drawings, hydration tank 50 is preferably a T-tank 50 having a bottom portion 68 and an upper or top portion 70. Hydration tank 50 includes a plurality of gel inlets 72 having an entrance 74 and an exit 76. Gel is communicated into hydration tank 50 from a pre-blender (not shown) through gel inlets 72. Hydration tank 50 likewise includes the drain conduit 32, and includes a plurality of gel outlets 78. Lower end 33 of drain conduit 32 is positioned over, and may extend into, depression or cup 63 formed in tank bottom 60.

Hydration tank 50 includes a roll tube 80 which can communicate fluid from outflow portion 66 to the pre-blender. The pre-blender typically communicates gel into hydration tank 50 through gel inlets 72. When hydration tank 50 is being utilized to supply the fracturing gel or other fluid to a well so that gel is flowing out of outflow portion 66 through gel outlets 78, a valve or other mechanism closes roll tube 80 to prevent flow therethrough. However, there are times when it is desired to continue to circulate fluid through the hydration tank 50 without allowing flow out of gel outlets 78. This is a process known as rolling fluid. When rolling fluid, a valve or other mechanism in roll tube 80 is opened, and gel is flowed into hydration tank 50 through gel inlets 72 to fill hydration tank 50. Gel outlets 78 are closed to prevent flow therethrough. Fluid is communicated over weir plate 62 and is communicated from outflow portion 66 through roll tube 80 back into the pre-blender so that the gel can be continually circulated.

Hydration tank 50 likewise includes a plurality, and preferably two valves 82 positioned in bottom portion 68 of hydration tank 50. Valves 82 preferably have screens 84 thereover to prevent contamination thereof. Valves 82 provide communication between inflow portion 64 and outflow portion 66. Valves 82 will be open to communicate gel from inflow portion 64 into outflow portion 66 when it is desired to empty inflow portion 64.

Hydration system or hydration apparatus 52 comprises a plurality of flow conduits or flow tubes 90, which are preferably perforated flow conduits 90. Hydration system 52, which may be referred to as a dispersion system, further includes a plurality of deflectors 91 which, as will be explained in more detail hereinbelow, are positioned to deflect, or disperse gel exiting flow conduits 90. Flow conduits 90 are communicated with gel inlets 72 and redirect the flow of incoming gel passing therethrough into the interior of hydration tank 50. In the embodiment shown, each of flow conduits 90 has a generally 90° bend so that it redirects incoming gel flow from a generally horizontal direction to a generally vertically upward direction.

Flow conduits 90 may comprise inner flow conduits 92 and outer flow conduits 94. Inner flow conduits 92 include an entrance 96 and an exit 98. Inner flow conduits 92 preferably taper radially inwardly at exit 98. Inner flow conduits 92 have a generally horizontal portion 100 and a generally vertical portion 102. Generally horizontal portion 100 has a longitudinal central axis 104. Generally vertical portion 102 has a longitudinal central axis 106. Inner flow conduits 92 have a height 108 measured from longitudinal central axis 104 to exit 98. Inner flow conduits 92 are preferably perforated, and thus have a plurality of ports or openings 110 through the side or wall thereof. Ports 110 are preferably defined in vertical portion 102 but may be positioned anywhere in inner flow conduits 92.

Deflectors 91 include inner deflectors or deflector plates 112 positioned so that gel exiting inner flow conduits 92 through exits 98 will engage inner deflectors 112 and be deflected or dispersed into existing gel in hydration tank 50. In the embodiment shown, gel exiting inner flow conduits 92 through exits 98 will exit in a generally upwardly vertical direction and will engage inner deflectors 112 which will cause the gel to be redirected vertically downwardly and to be dispersed in hydration tank 50. Deflector plates 112 may be connected in hydration tank 50 in any manner known in the art and in the embodiment shown are preferably connected with straps 114 or other means to inner flow conduits 92.

Outer flow conduits 94 have an entrance 122 and an exit 124. Outer flow conduits 94 preferably taper radially inwardly at exit 124. Outer flow conduits 94 comprise a generally horizontal portion 126 and a generally vertical portion 128. Generally horizontal portion 126 has a longitudinal central axis 130 and generally vertical portion 128 has a longitudinal central axis 132. Outer flow conduits 94 have a height 134 measured from longitudinal central axis 130 to exit 124. Height 134 is preferably smaller in magnitude than height 108.

Outer flow conduits 94 are preferably perforated flow conduits and thus include a plurality of ports or openings 136 through the side or wall thereof. Deflectors 91 include outer deflectors 138 which are positioned over exits 124 to engage and deflect, or disperse gel exiting outer flow conduits 94. Outer deflectors 138 may be connected in hydration tank 50 by any means known in the art and in the embodiment shown are connected to outer conduits 94 with straps 140. Flow conduits 90 may be attached or supported in hydration tank 50 with metal straps, brackets, or other connecting means known in the art.

The operation of hydration tank 50 is as follows. Hydration tank 50 will be initially filled with gel provided from a pre-blender or other source (not shown) through gel inlets 72 and flow conduits 90. The gel will comprise a mixture of LGC and water. As set forth previously, the LGC may comprise a mixture of guar and diesel in an amount such that the resulting LGC has a four pounds of guar per gallon of LGC ratio. A typical fracturing fluid may require, for example, twenty pounds of guar per thousand gallons of gel. Thus, a 400-barrel tank, which will hold 16,800 gallons of gel, will require 336 pounds of guar. Thus, 84 gallons of LGC are needed in a 400-barrel tank. The hydration tank 50 is initially filled with gel through gel inlets 72, and because of the time it takes to fill, the initial gel in hydration tank 50 will be sufficiently hydrated so that valves on gel outlets 78 may be opened and the gel in hydration tank 50 can be communicated to a blender tub or other device for mixing proppant with the gel. Gel may flow out of hydration tank 50 at a rate of approximately forty barrels per minute so that it is desirable to have a flow rate of incoming gel of approximately forty barrels per minute. As set forth above, it may be that the flow rate into hydration tank 50 is less than the flow rate out, for example, 32–36 barrels per minute. Incoming gel is communicated into hydration tank 50 from a pre-blender or other device, which mixes the LGC with water in a desired ratio for a desired viscosity. Utilizing the ratios already provided, incoming gel will comprise 8.4 gal. LGC/40 bbl gel. Such a composition will provide a viscosity of approximately 8 centipoise at 120° F., and approximately 13 centipoise at 60° F. assuming a hydration time of about 9 to 11 minutes. The numbers given here are exemplary and it is known in the art that different compositions will result in different viscosities. For example, increasing the guar content of the gel will result in increased viscosity. The gel, however, to reach its maximum viscosity, should hydrate for approximately 9–11 minutes.

Incoming gel is communicated through gel inlets 72 and into inner and outer flow conduits 92 and 94. The direction of flow of the incoming gel is redirected by inner and outer flow conduits 92 and 94 from generally horizontal to generally vertically upwardly. Incoming gel exits outer flow conduits 94 through exits 124 in a generally vertically upward direction, and is engaged by outer deflectors 138 which redirects flow downwardly and outwardly so that it disperses incoming gel into existing gel in hydration tank 50. Likewise, gel exits inner flow conduits 92 in a generally vertically upward direction through exits 98 and engages inner deflectors 112 so that the incoming gel is deflected downwardly and outwardly into existing gel. Incoming gel likewise passes through ports 136 in outer flow conduits 94 and through ports 110 in inner flow conduits 92. In the embodiment shown, ports 110 direct the flow of incoming gel generally directly toward inflow end 54 and angularly toward inflow end 54. Ports 136 direct incoming gel generally directly toward outflow end 56 and angularly toward outflow end 56. Thus, ports 136 and 110 create multi-directional flow, and direct incoming gel in a plurality of directions to disperse incoming gel throughout existing gel in hydration tank 50. Likewise, incoming gel passing through exits 98 and 124 of inner and outer flow conduits 92 and 94, respectively, is dispersed into existing gel in hydration tank 50. It has been determined that at least ten minutes passes before gel passing through flow conduits 90 reaches gel outlets 78 so that gel hydrates for at least ten minutes. The hydration tank 50 of the present invention therefore allows the incoming gel to fully hydrate.

Standard hydration tanks, like that shown in FIG. 1, do not allow incoming gel to hydrate sufficiently. Incoming gel in such hydration tanks may pass from the inlets to the outlets thereof in a period of approximately two minutes. The gel composition described herein generally enters the tank at three to four centipoise, and with a hydration time of only two minutes, the gel will not approach the viscosity of a fully hydrated gel. One way to raise viscosity is to increase the amount of guar, or increase the amount of LGC in the gel, but such a change increases the costs associated with the fracturing process. With the present invention, the gel hydrates at least ten minutes, so the gel is fully hydrated, and reaches its desired viscosity.

The foregoing descriptions of specific embodiments of the present invention have been presented for purposes of illustration and description. They are not intended to be exhaustive or to limit the invention to the precise forms disclosed and obviously many modifications and variations are possible in light of the above teaching. The embodiments were chosen and described in order to best explain the principles of the invention and its practical application, and thereby enable others skilled in the art to best utilize the invention and various embodiments with various modifications that are suited to the particular use contemplated. It is intended that the scope of the invention be defined by the claims appended hereto and their equivalents.

What is claimed is:

1. A hydration tank for hydrating gel, the hydration tank comprising:

a forward end;

a rear end;

side walls connecting the forward and rear ends;

a plurality of gel inlets for communicating gel from the exterior of the hydration tank to an interior of the hydration tank;

a plurality of gel outlets for communicating gel from the interior of the hydration tank to the exterior of the hydration tank; and a dispersion system operably associated with the gel inlets for dispersing incoming gel passing through the gel inlets into existing gel in the hydration tank.

2. The hydration tank of claim 1, wherein the dispersion system comprises:

a plurality of flow conduits for communicating the incoming gel into an interior of the hydration tank, wherein each flow conduit is connected to a gel inlet; and a plurality of deflectors for deflecting the incoming gel after the incoming gel exits the flow conduits.

3. The hydration tank of claim 1, wherein the dispersion system comprises a plurality of flow conduits, each flow conduit is connected to a gel inlet, and the incoming gel is communicated into the hydration tank through perforations in the flow conduits.

4. The hydration tank of claim 3, wherein the perforations in the flow conduits direct the incoming gel in a plurality of directions in the hydration tank.

5. The hydration tank of claim 3, wherein the dispersion system further comprises a plurality of deflectors positioned in the hydration tank to deflect the incoming gel passing through the flow conduits.

6. The hydration tank of claim 3, wherein the incoming gel is also communicated into the hydration tank through exit ends of the flow conduits.

7. The hydration tank of claim 6, wherein the dispersion system further comprises deflectors positioned to redirect the flow of the incoming gel passing through the exit ends of the flow conduits.

8. A hydration tank for hydrating a gel, the hydration tank comprising:

an inflow portion;

an outflow portion;

a weir separating the inflow portion from the outflow portion;

a plurality of gel inlets for communicating incoming gel from the exterior of the hydration tank into the inflow portion of the hydration tank;

a plurality of gel outlets for communicating gel from the outflow portion of the hydration tank to the exterior of the hydration tank; and, a gel dispersion system for dispersing the incoming gel into existing gel in the inflow portion of the hydration tank.

9. The hydration tank of claim 8, wherein the gel dispersion system limits fingering of the incoming gel through the existing gel in the hydration tank.

10. The hydration tank of claim 8, wherein the gel dispersion system increases a hydration time of the incoming gel.

11. The hydration tank of claim 8, wherein the gel dispersion system comprises a plurality of flow conduits for redirecting the direction of flow of the incoming gel, and each flow conduit is connected to a gel inlet.

12. The hydration tank of claim 11, wherein at least a portion of the flow conduits is perforated.

13. The hydration tank of claim 11, wherein at least a portion of the flow conduits directs the flow of the incoming gel substantially vertically upwardly.

14. The hydration tank of claim 11, wherein the gel dispersion system further comprises a plurality of deflectors positioned in the hydration tank, and the incoming gel passing through an exit end of each flow conduit is redirected by one of the deflectors.

15. The hydration tank of claim 14, wherein each deflector is attached to a flow conduit and is positioned over the exit end thereof.

16. The hydration tank of claim 11, wherein at least a portion of the flow conduits redirects the direction of flow of the incoming gel from generally horizontal to a generally vertically upward.

17. The hydration tank of claim 16, wherein at least a portion of the flow conduits is perforated.

18. The hydration tank of claim 16, further comprising a plurality of deflectors, wherein the incoming gel passing through an exit end of each flow conduit is deflected by a deflector.

19. The hydration tank of claim 18, wherein a deflector is positioned directly above each flow conduit and redirects the incoming gel passing through the exit end thereof generally downwardly.

* * * * *